United States Patent [19]

Levitt et al.

[11] 4,269,318

[45] May 26, 1981

[54] SHEET METAL SHELF

[76] Inventors: Ben Levitt, 65 Downshire Rd., Hampstead, Quebec; Irving Levitt, 4900 Côte St. Luc Rd., Apt. 1008, Montreal, Quebec, both of Canada

[21] Appl. No.: 73,435

[22] Filed: Sep. 7, 1979

[51] Int. Cl.[3] ..... A47F 5/00

[52] U.S. Cl. ..... 211/153; 211/135

[58] Field of Search ..... 211/135, 153, 187; 108/106, 107, 111

[56] References Cited

U.S. PATENT DOCUMENTS

| | | | |
|---|---|---|---|
| 1,996,518 | 4/1935 | Levene et al. | 211/135 X |
| 2,374,658 | 5/1945 | Bales | 211/153 |
| 3,168,365 | 2/1965 | Evans | 211/135 X |
| 3,276,403 | 10/1966 | Ferdinand et al. | 108/106 X |

FOREIGN PATENT DOCUMENTS

| | | | |
|---|---|---|---|
| 723011 | 12/1965 | Canada | 211/187 |

*Primary Examiner*—Roy D. Frazier
*Assistant Examiner*—Robert W. Gibson, Jr.
*Attorney, Agent, or Firm*—Larson, Taylor and Hinds

[57] ABSTRACT

An improved sheet metal shelf is disclosed which may be made without welding, thus allowing prepainted or finished metal sheet to be used. The shelf is a one piece metal shelf having a top panel, side walls and end walls extending down from the sides and ends respectively of the top panel, and co-operating means on the side and end walls for mechanically joining the side and end walls together at the corners of the shelf.

5 Claims, 4 Drawing Figures

Fig. 3
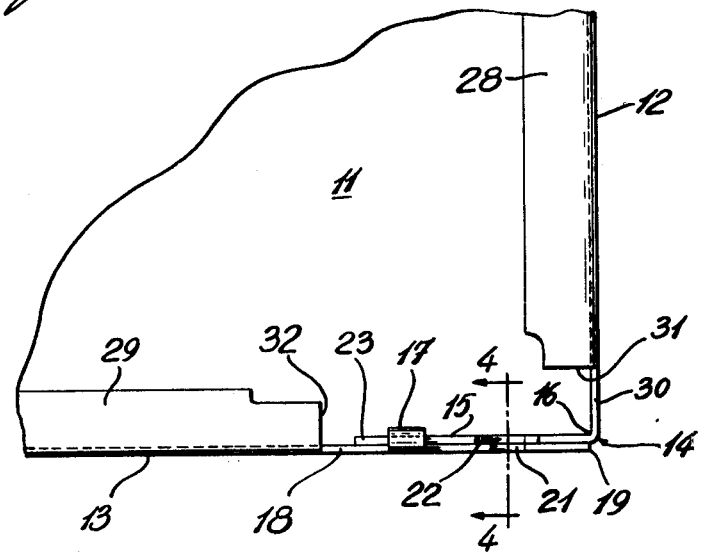
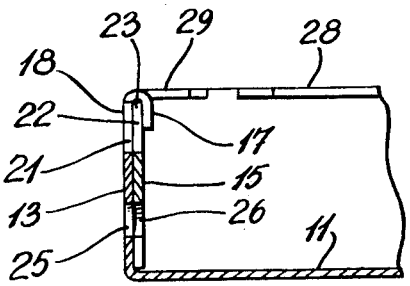
Fig. 4

SHEET METAL SHELF

This invention is directed toward an improved shelf. The invention is more particularly directed toward an improved, one-piece, sheet metal shelf.

One-piece, metal shelves are well known and comprise a rectangular top panel with narrow side and end walls extending down from the sides and ends respectively of the top panel to provide a rigid shelf construction. Preferably narrow flanges extend inwardly from the bottom free edges of the side and end walls to further strengthen the shelf. In the prior art, the side and end walls are welded together at the corners of the shelf to provide a rigid shelf construction. The shelf is stamped out in one piece from a metal sheet and then bent to provide the side and end walls and the flanges.

The welding step, however, precludes the use of prepainted or decorated metal sheet, or of galvanized steel sheet, since the welding step can mar the appearance of such sheets. And to paint or decorate the formed shelf after welding is more costly than prepainting or predecorating the sheet before it is used to form a shelf.

The present invention provides an improved shelf which can use prepainted or predecorated metal sheet. The improved shelf employs a mechanical connection at the corners to join the side and end walls rather than a welded connection. The mechanical connection provides a strong, rigid structure yet does not disfigure or mar the appearance of the metal sheet. Thus prepainted metal sheet or galvanized steel sheet can be employed thereby reducing the finished cost of the improved shelf.

The mechanical connection joining the end and side walls of the shelf of the present invention comprise cooperating tabs projecting from the end and side walls which mechanically lock the walls together at the corners to provide a rigid shelf construction.

The invention is particularly directed toward a one-piece, metal shelf having a top panel and side and end walls extending down from the sides and ends respectively of the top panel. Cooperating means are provided on the side and end walls for mechanically joining the side and end walls together at the corners of the shelf.

The joining means comprise a first tab extending laterally from each end edge of each of one of the side or end walls and bent to lie against the other of the end or side walls. A second tab extends from the side edge, near each end edge, of each of the other of the side or end walls, each second tab bent to overlie a respective first tab to hold it tight against the other end or side wall.

The invention will now be described in detail having reference to the accompanying drawings in which:

FIG. 3 is a detail bottom plan view of one corner of the shelf shown in FIG. 1, and FIG. 4 is a cross-sectional view taken along line 4—4 of FIG. 3.

The shelf 10 of the present invention is made from suitable sheet metal material, such as steel for example, and comprises a rectangular top panel 11, a pair of narrow side walls 12, and a pair of narrow end walls 13. The side walls 12 are integral with top panel 11 and extend down from the edges of the top panel 11. Similarly the end walls 13 are integral with the top panel 11 and extend down from the edges of the top panel 11. The side and end walls 12,13 are bent down from the top panel 11 to extend generally perpendicular to the top panel 11. The sheet metal material may be a prepainted steel or aluminum sheet metal, may be anodized aluminum, specially coated steel or aluminum with a pattern or other decoration thereon. The sheet metal may also be galvanized sheet steel.

Figure 1:
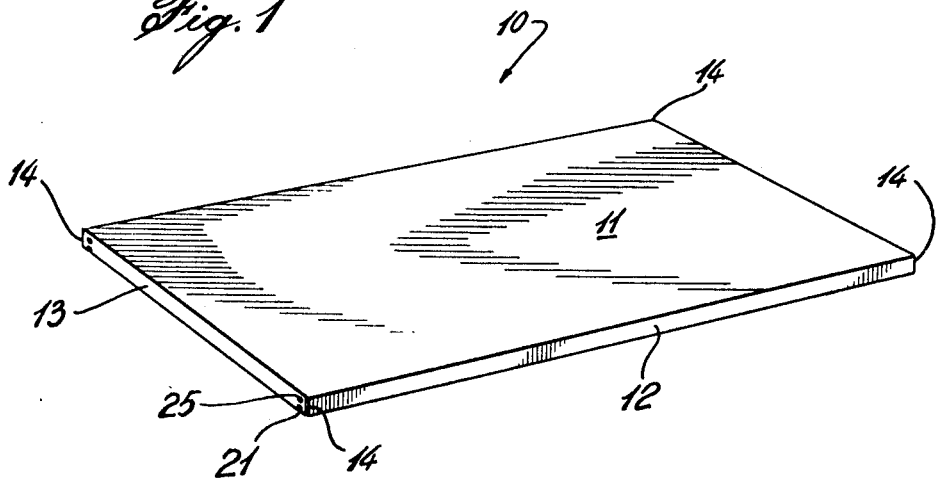
FIG. 1 is perspective view of a shelf according to one embodiment of the present invention.
Figure 2:
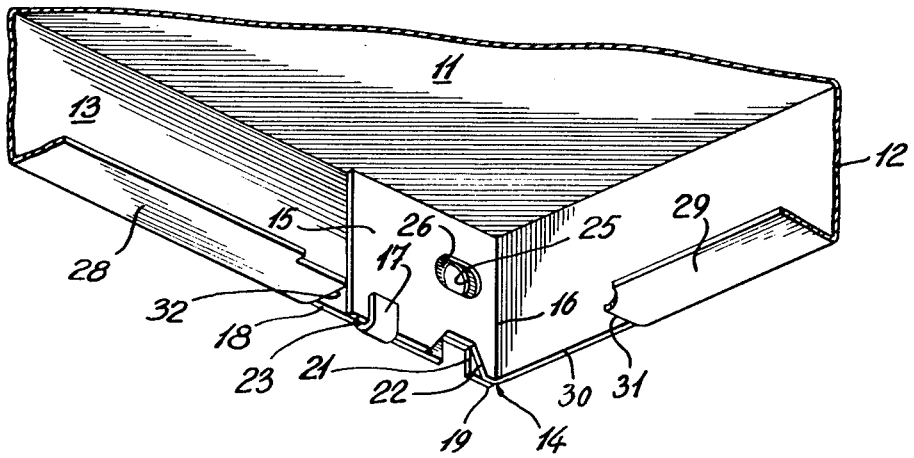
FIG. 2 is a detail perspective view of one corner of the shelf shown in FIG. 1.

Cooperating joining means are provided on the side and end walls at each corner 14 of the shelf for mechanically joining them together to provide a rigid shelf structure. The cooperating joining means include a first tab 15 as shown in FIG. 2 extending laterally from each end 16 of each of the side walls 12. The first tabs 15 have the same width as both the side and end walls and are bent inwardly to extend generally perpendicular to the side walls 12 and to lie against the end walls 13. The first tabs 15 lie against the inner surface of the end walls 13.

The cooperating joining means also includes a second tab 17 extending from the free bottom edge 18 of each end wall 13 near each end edge 19 of the end wall 13. The second tab 17 at each end of each end wall 19 is bent inwardly and upwardly to overlie the first tab 15 at each corner 14 of the shelf to retain the first tab 15 tight against the end wall 13.

In the embodiment shown, the shelf 10 includes locating means at each corner 14 for use in mounting the shelf. The locating means comprises a first rectangular or square notch 21 adjacent each end 19 of each end wall 13. The first notch 21 at each end extends inwardly from the bottom edge 18 of the end wall 13 and is positioned between each end 19 of the end wall 13 and the second tab 17. A second notch 22 is provided in each first tab 15 tapering inwardly from its bottom edge 23. The second notch 22 is positioned to be aligned with the first notch 21 at each corner when the first tab 15 is against the end wall 13. The second notch 22 is shown with its bottom edge wider than the first notch 21 to ensure that the notches align.

The shelf 10 is generally supported by resting on a shelf support which is not shown. The corners 14 support the shelf 10 and the notches 21,22 locate the shelf 10 on the support. In some cases the shelf is provided with a mounting hole at each corner so it may be supported by shelf clips or hooks.

In the embodiment shown, a mounting hole is illustrated in each corner 14 which includes a first hole 25 near each end 19 of each end wall 13. The first hole 25 is circular and located above the first notch 21. A second hole 26 is provided in tab 15 positioned to be aligned with first hole 25 when tab 15 is against the end wall 13. The second hole 26 is a slot larger than the first hole 25 to ensure alignment of the two holes.

Flanges are provided on the side and end walls 12,13 to strengthen the shelf 10. A flange 28 is provided on each end wall 13 between tabs 15, extending inwardly from the bottom edge 18 perpendicular to the end wall 13 and parallel to the top panel 11. A flange 29 is provided on each side wall 12 between its ends 16 extending inwardly from its free bottom edge 30, perpendicular to the side wall 12 and parallel to the top panel 11. The ends 31 of flange 29 are spaced inwardly from the ends 16 of the side wall 12 a distance slightly greater than the width of flanges 28. The ends 32 of flanges 28 are spaced inwardly from the ends 19 of end walls 13 a distance slightly greater than the length of the first tabs 15.

The shelf 10 according to the present invention, is strong and rigid with the side and end walls securely joined at the corners without welding. The construction of the shelf is such that it can be easily stamped in one piece out of a steel sheet and then bent on a press brake or cold rolled to form the final shape of the shelf. The first tabs 15 of the stamped piece are bent to extend perpendicular to the side walls as is the flange 29 on each side wall 12. The side walls 12 are then bent to extend perpendicular to the top panel 11. The second tabs 17 and flanges 28 are then bent to extend perpendicular to the end walls 13 and the end walls 13 are then bent to extend perpendicular to the top panel 11 and to lie against the first tabs 15. Second tabs 17 are then bent again to lie against the first tabs 15 thereby locking the side and end walls 12,13 together at the corners.

While a rectangular shelf has been described, the shelf could have a square shape as well. Also, while the side walls 12 of the shelf have been provided with the first tabs 15 and the end walls 13 have been provided with the second tabs 17, the first and second tabs can be switched with the first tabs 15 being provided on the end walls 13 and the second tabs 17 being provided on the side walls 12. The first tabs 15 lie against the inner surface of the adjacent walls for appearance sake, but they can also lie against the outer surface if desired.

The embodiments of the invention in which an exclusive property or privilege is claimed are defined as follows:

1. A one-piece metal shelf having a top panel, side walls and end walls extending down from the sides and ends respectively of the top panel, and cooperating means on the side and end walls for mechanically joining the side and end walls together at the corners of the shelf, said cooperating means comprising a first tab extending laterally from each end of each of one of the side or end walls, each first tab bent to lie against one of the other of the side or end walls; and a second tab extending from the free side edge, near each end edge, of each of the other of the side or end walls, each second tab bent to lie over a respective first tab to hold it against a respective side or end wall.

2. The shelf as claimed in claim 1 wherein each first tab lies against the inner surface of each other side or end wall.

3. The shelf as claimed in claim 1 including locating means near each corner, the locating means comprising a first notch in the other side or end wall near the corner and a second notch in the first tab positioned to be aligned with the first notch when the tab lies against the other side or end wall, the second notch being wider than the first notch.

4. The shelf as claimed in claim 1 including means near each corner for use in supporting the shelf from shelf clips comprising a first hole in the other side or end wall near each corner and a second hole in the first tab positioned to be aligned with the first hole when the first tab lies against the other side or end wall, the second hole being larger than the first hole.

5. The shelf as claimed is claim 1 when made from prepainted sheet metal.

* * * * *